US008875448B2

(12) United States Patent
Korkiamäki

(10) Patent No.: US 8,875,448 B2
(45) Date of Patent: Nov. 4, 2014

(54) METHOD AND APPARATUS FOR THE INSTALLATION OF A LIFTING LOOP, AND PART FORMING A LIFTING LOOP

(71) Applicant: Elematic Oy AB, Toijala (FI)

(72) Inventor: Pekka Korkiamäki, Toijala (FI)

(73) Assignee: Elematic Oy AB, Toijala (FI)

( * ) Notice: Subject to any disclaimer, the term of this patent is extended or adjusted under 35 U.S.C. 154(b) by 0 days.

(21) Appl. No.: 13/792,629

(22) Filed: Mar. 11, 2013

(65) Prior Publication Data

US 2013/0234460 A1 Sep. 12, 2013

(30) Foreign Application Priority Data

Mar. 12, 2012 (FI) ..... 20125266

(51) Int. Cl.

| | |
|---|---|
| ***E02D 35/00*** | (2006.01) |
| ***E04G 21/14*** | (2006.01) |
| ***B28B 23/00*** | (2006.01) |

(52) U.S. Cl.

CPC ..... *E04G 21/142* (2013.01); *B28B 23/0062* (2013.01); *E04G 21/145* (2013.01)

USPC ..... 52/125.2; 52/122.1; 52/125.1; 52/125.4; 52/125.5; 52/125.6; 52/698; 52/699; 52/700

(58) Field of Classification Search

CPC ..... E04B 1/41; E04G 15/04; E04G 21/142; B28B 23/0062

USPC ..... 52/122.1, 125.1, 125.2, 125.4, 125.5, 52/125.6, 698, 699, 700

See application file for complete search history.

(56) References Cited

U.S. PATENT DOCUMENTS

| | | | | | |
|---|---|---|---|---|---|
| 4,087,947 | A | * | 5/1978 | Turner | 52/125.4 |
| 4,603,522 | A | * | 8/1986 | Johnson | 52/125.4 |
| 4,627,198 | A | * | 12/1986 | Francies, III | 52/125.5 |
| 5,469,675 | A | * | 11/1995 | Arteon | 52/125.5 |
| 6,279,274 | B1 | * | 8/2001 | Amiet et al. | 52/125.2 |

(Continued)

FOREIGN PATENT DOCUMENTS

| | | | | |
|---|---|---|---|---|
| FR | 2833285 | A1 | | 6/2003 |
| FR | EP1555100 | | * | 1/2005 |
| FR | 2885548 | A1 | | 11/2006 |
| WO | WO 2008/025894 | A2 | | 3/2008 |

OTHER PUBLICATIONS

Finnish Search Report issued on Jan. 11, 2013, for Finnish Application No. 20125266.

(Continued)

*Primary Examiner* — Mark Wendell

(74) *Attorney, Agent, or Firm* — Dickinson Wright PLLC

(57) ABSTRACT

A method for the installation of a lifting loop in a fresh hollow core slab, said hollow core slab having its top surface broken for an opening substantially in line with a neck between the cavities, and said method comprises placing in the obtained opening a lifting loop-forming part set to bear against the hollow core slab's pre-stressing strands, the lifting loop-forming part's end sections being placed under the hollow core slab's pre-stressing strands by providing either a permanent or temporary deformation in the lifting loop-forming part. The invention relates also to an apparatus for implementing such a method, as well as to a lifting loop-forming part compatible with the method.

11 Claims, 4 Drawing Sheets

(56) References Cited

U.S. PATENT DOCUMENTS

Figure 1:
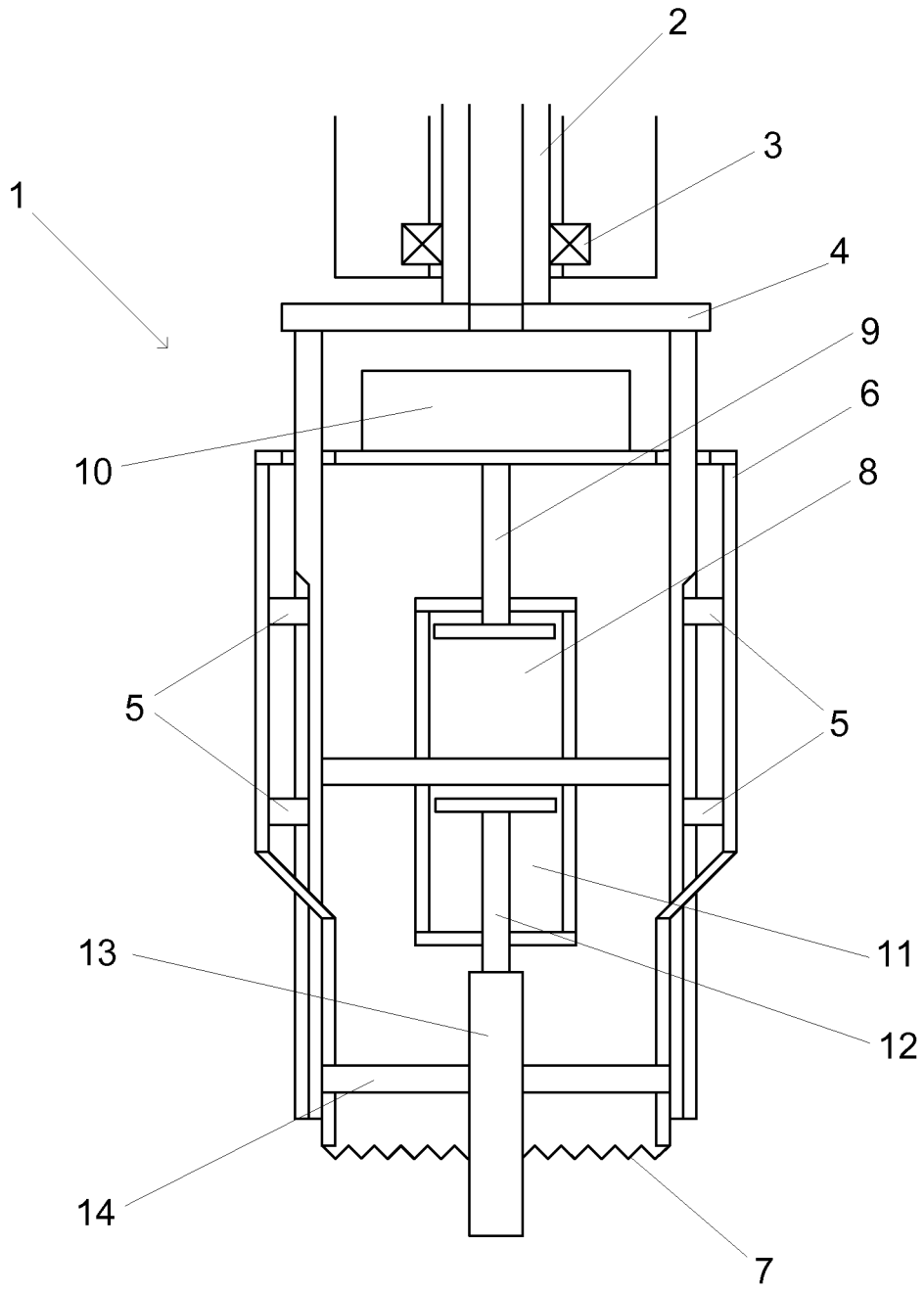

| | | | | |
|---|---|---|---|---|
| 2006/0248811 | A1* | 11/2006 | Hansort | 52/122.1 |
| 2008/0010926 | A1* | 1/2008 | Jarvinen et al. | 52/333 |
| 2009/0107057 | A1* | 4/2009 | Hansort | 52/125.4 |
| 2009/0183441 | A1* | 7/2009 | Azarin | 52/125.5 |
| 2009/0320386 | A1* | 12/2009 | Mackay Sim | 52/125.4 |
| 2010/0037536 | A1* | 2/2010 | Schulze | 52/125.4 |

OTHER PUBLICATIONS

Finnish Office Action issued on Jan. 11, 2013 for Finnish Application No. 20125266.

Betoniteollisuus Ry, Betonielementtien nostolenkit ja—ankkurit, Suomen Rakennusmedia Oy, Tammerprint Oy 2010, Jan. 1, 2011, pp. 1-5.

* cited by examiner

METHOD AND APPARATUS FOR THE INSTALLATION OF A LIFTING LOOP, AND PART FORMING A LIFTING LOOP

The invention relates to the installation of lifting loops for slipformed hollow core slabs provided with pre-stressing strands. More specifically, the invention relates to a method and apparatus for the installation of a lifting loop bearing against the pre-stressing strands of a hollow core slab, as well as to a part that forms such a lifting loop bearing against the pre-stressing strands of a hollow core slab.

For hoisting slipformed hollow core slabs, it is a recently adopted practice to provide a top surface of the slabs with lifting loops attached thereto, said lifting loops enabling crane hooks to be secured therein. Typically, the installation of lifting loops is conducted by breaking the top surface of a hollow core slab either in line with a cavity or in line with neck between the cavities, and by placing a lifting loop-forming part in the thus obtained recess.

Typically, the lifting loop is positioned in a hollow core slab in such a way that its highest point is flush with the hollow core slab's top surface, and the lifting loop is provided with a cup-shaped part extending from the hollow core slab's top surface to a position therebelow. Hence, it is easy to conceal the lifting loop for example with grout after setting the hollow core slab in its place, and no other measures caused by the lifting loop are necessary for providing a smooth top surface for the hollow core slab.

For enhancing and ensuring the gripping and bonding of a lifting loop, it is prior known that, during the lifting loop installation, a part which forms the lifting loop is turned while subjecting the part to vibration, thereby forcing the ends of the lifting loop-forming part to become embedded in the necks of a hollow core slab and to place themselves under the pre-stressing strands present within the necks. The thus obtained bearing of lifting loops against the pre-stressing strands of a hollow core slab provides a major improvement regarding the attachment of lifting loops to the hollow core slab and prevents the same from ripping off as the hollow core slab is being lifted. Such lifting loop solutions have been presented in publications EP 1 878 854 and WO 2008025894.

A problem with these lifting loops bearing against the pre-stressing strands is a large opening in the hollow core slab's top surface required for the installation thereof because of a large mutual distance between the ends of a lifting loop-forming part to be brought under the pre-stressing strands by turning. A large opening broken in the hollow core slab's surface results in a major need of patching after the lifting loop installation and weakens the slab structure. The manufacture of a lifting loop-forming part in these prior art solutions is also an inconvenient process due to the necessity of making bends in several different planes, as well as due to a strict tolerance in the lifting loop sections to be set under the pre-stressing strands.

Another problem encountered in the case of these prior known lifting loops to be set by turning concerns damage and risks of damage to a hollow core slab caused by the structure of a lifting loop-forming part whenever the hollow core slab's lifting lugs are subjected to oblique forces in the lifting process. These oblique lifting forces result in the condition that just one of the lifting loop sections set under the pre-stressing strands bears against the strands, while forcing the other underlying lifting loop section toward the hollow core slab's bottom surface, which may lead to a rupture of the hollow core slab's bottom.

In a solution according to the present invention, the lifting loop-forming part is constructed with bends made substantially in just one plane, and during a lifting loop installation process, the lifting loop-forming part is given either a permanent or temporary deformation for placing the ends of the lifting loop-forming part under the pre-stressing strands of a hollow core slab.

The solution according to the invention enables bringing a lifting loop to bear against the pre-stressing strands of a hollow core slab substantially at the same location along the length of the hollow core slab. In addition, the mutual distance between the lifting loop sections set under the pre-stressing strands is minimized, i.e. the mutual distance between these sections at its maximum matches preferably the lifting loop's width. Hence, this enables a minimization of the forces generated in the lifting process by the lifting loop sections set under the pre-stressing strands which are directed towards the hollow core slab's bottom due to the oblique lifting forces affecting the lifting loop, which considerably reduces the rupturing hazard of the hollow core slab's bottom. In addition, the load applied to the lifting loop is distributed evenly on both sections of the lifting loop-forming part set under the prestressing strands.

The lifting loop-forming part for use in a solution of the invention is also considerably easier to manufacture than the prior art lifting loops bearing against pre-stressing strands, because the lifting loop of the invention only requires bends to be made in one or substantially in one plane. This reduces considerably the manufacturing costs of a lifting loop-forming part.

Moreover, in terms of its maximum dimensions, the lifting loop-forming part of the invention is considerably smaller with respect to its prior known counterparts, whereby its installation requires breaking the hollow core slab's top surface over a remarkably smaller area. Preferably, this area to be broken has a maximum diameter which is substantially equal to the largest dimension of just the lifting loop section of a lifting loop-forming part.

It is further possible to use a lifting loop solution of the invention with hollow core slabs with a smaller material thickness than those useful for prior art lifting loops bearing against pre-stressing strands.

In a solution of the invention, the either permanent or temporary deformation of a lifting loop-forming part is preferably brought about by moving the end sections of the lifting loop-forming part away from or toward each other.

In a solution of the invention, the lifting loop-forming part is preferably vibrated during its placement. This vibration serves to improve the bonding of concrete mix to the lifting loop-forming part, and especially to its end sections to be placed under the hollow core slab's pre-stressing strands.

In a solution of the invention, the concrete mix broken off the hollow core slab's top surface in the process of making the opening is preferably utilized by compacting this concrete mix next to the lifting loop-forming part. The result is an enhanced anchoring of the lifting loop-forming part in the hollow core slab.

The apparatus according to the invention comprises preferably also means for breaking the top surface of a hollow core slab and for making an opening substantially in line with a neck between the cavities of a fresh hollow core slab. Therefore, all measures required for the installation of a lifting loop can be carried out with one and the same apparatus. Hence, the apparatus of the invention also enables the placement of a lifting loop to be performed at least to some extent concurrently with breaking the hollow core slab's top surface. In this context, it should be noted that, in a solution of the invention, the breaking of a hollow core slab's top surface for making an opening substantially in line with a neck between the cavities of a fresh hollow core slab refers to the fact that the opening to be made has its midpoint set in alignment with a neck in the hollow core slab, but that the finished opening may extend, and usually does extend, into the hollow core slab's cavity sections on either side of the discussed neck.

The lifting loop-forming part for use in a solution of the invention is preferably constructed from a metal rod by bending, whereby all bends are preferably made in one and the same plane.

More specifically, the features of a method according to the invention are presented in claim 1, the features of an apparatus according to the invention are presented in claim 5, and the features of a lifting loop-forming part according to the invention are presented in claim 10.

Figure 2:
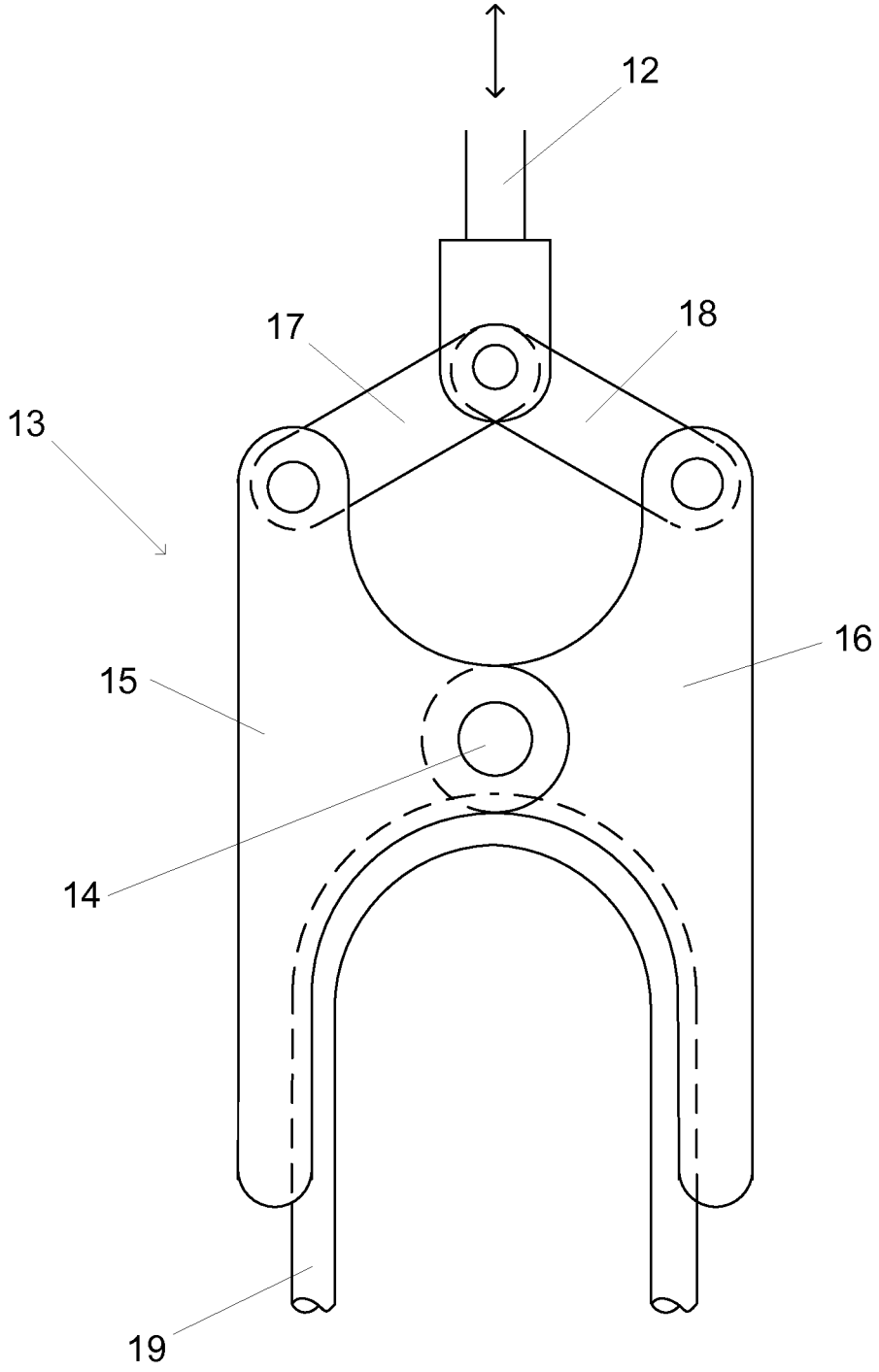
Figure 3A:
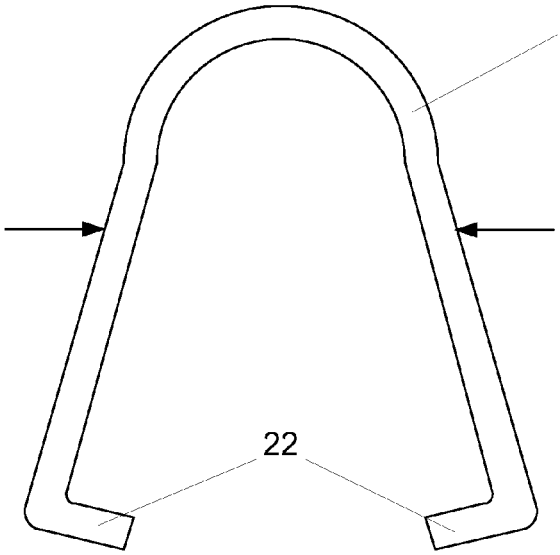
Figure 3B:
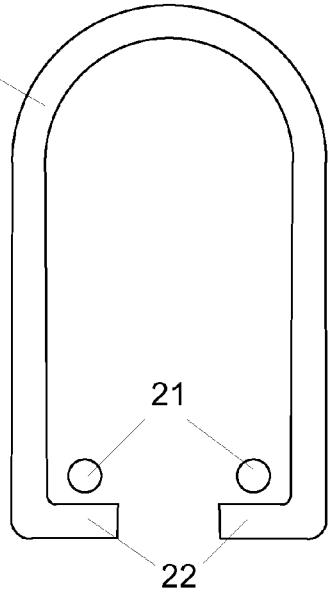
Figure 4A:
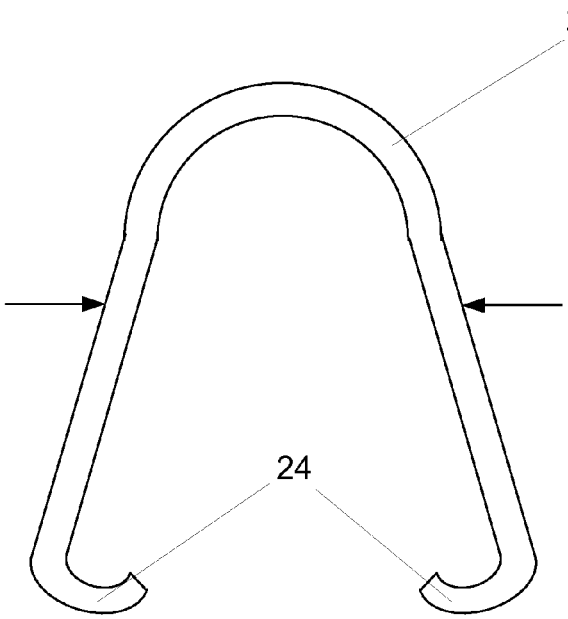
Figure 4B:
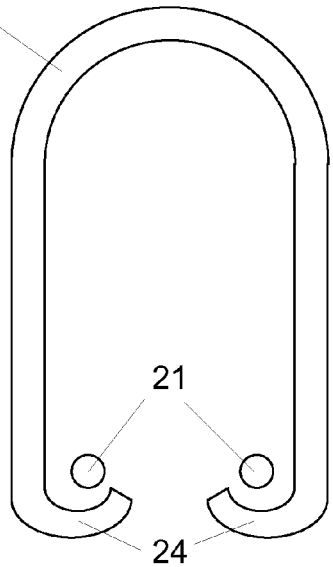
Figure 5A:
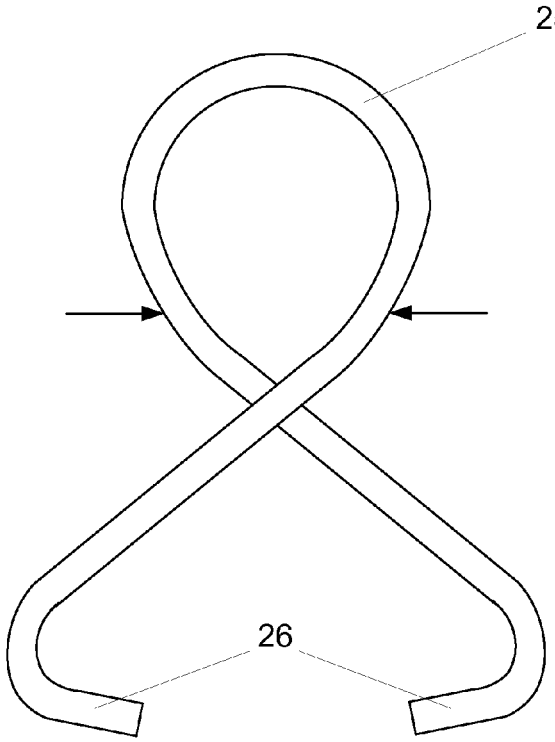
Figure 5B:
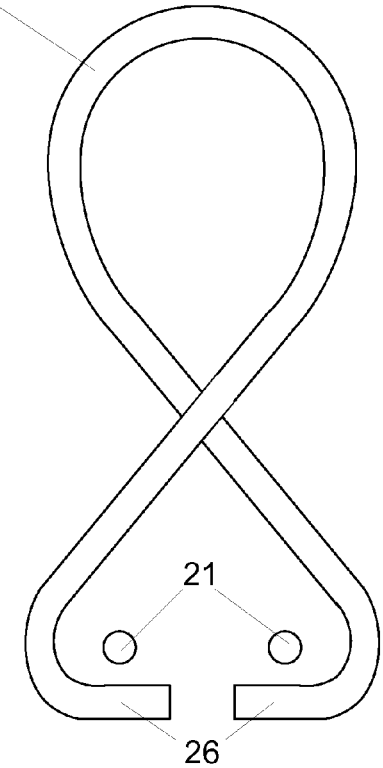
Figure 6A:
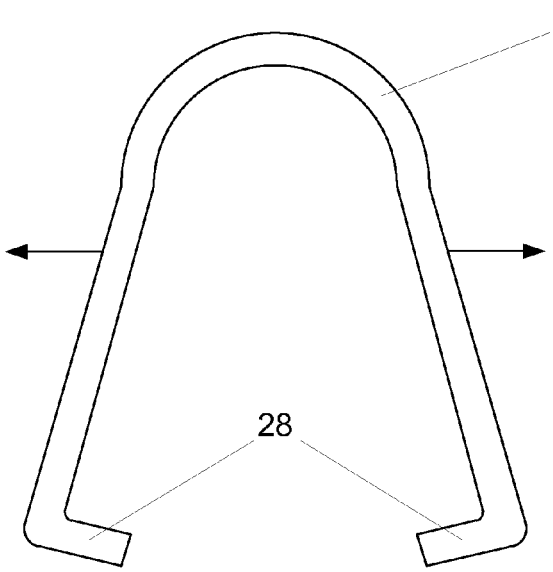
Figure 6B:
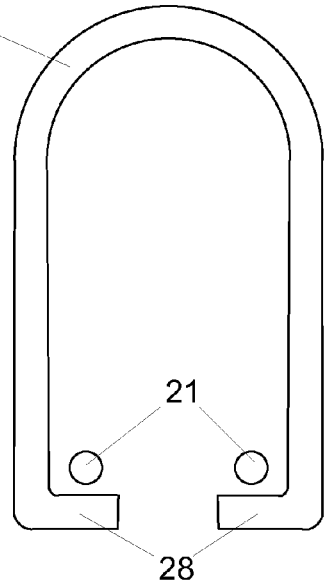

The invention will now be described more precisely by way of example with reference to the accompanying figures, in which FIG. 1 shows schematically in cross-section one gripper head of the invention for a lifting loop installation apparatus, FIG. 2 shows schematically a claw member for the gripping head of FIG. 1 in a side view, FIGS. 3A and 3B show schematically one first lifting loop-forming part of the invention, FIGS. 4A and 4B show schematically one second lifting loop-forming part of the invention, FIGS. 5A and 5B show schematically one third lifting loop-forming part of the invention, and FIGS. 6A and 6B show schematically one fourth lifting loop-forming part of the invention.

FIG. 1 shows in a schematic cross-sectional view a gripper head 1 intended for one lifting loop installation apparatus of the invention and provided with a mounting shaft 2 by which the gripper head connects to the rest of the apparatus. The mounting shaft 2 connects to the rest of the apparatus through bearings 3, whereby the mounting shaft enables the gripper head 1 to be rotated around its center axis.

To the end of the mounting shaft 2 is attached a frame element 4, on which is mounted by way of guides 5 a sawing unit 6 vertically movable in relation to the frame element 4, said sawing unit having its entire bottom edge provided with a saw blade 7. In order to move the sawing unit 6 in vertical direction relative to the frame element 4, there is fitted inside the frame element a hydraulic or pneumatic cylinder 8, the top end of its piston rod 9 being attached to an upper portion of the sawing unit. To a top surface of the sawing unit 6 is fixed a vibrator 10, by means of which the sawing unit can be used for the compaction of concrete mix effected by vibration.

Inside the frame element 4 is also fitted a second hydraulic or pneumatic cylinder 11, the outer end of its piston rod 12 being adapted to operate claws 13 grasping a lifting loop-forming part (not shown). The claws 13 are fixed to the frame element 4 via an axle 14. The construction of the claws 13 is illustrated in more detail in FIG. 2.

When operating a lifting loop installation apparatus shown in FIG. 1, the gripper head of the apparatus is placed in the proximity of a hollow core slab's top surface at the installation location of a lifting loop. After this, a rotation of the entire gripper head 1 is commenced by rotating the mounting shaft 2, and a down-ward movement of the sawing unit 6 relative to the frame element 4 is commenced by means of the cylinder 8 and its piston rod 9. Hence, the saw blade 7 of the sawing unit 6 begins to bite into the hollow core slab's top surface for making an opening. If necessary, the sawing operation is continued with the sawing unit 6 in its bottom position by lowering the entire gripper head 1 in vertical direction.

Once the opening has been cut and broken into the top surface of a fresh hollow core slab, the sawing unit 6 is raised up by shifting it by means of the cylinder 8 and its piston 9 relative to the frame element 4, and the gripper head rotation is stopped.

Next, the gripper head 1 is sent to pick up a lifting loop-forming part, which is to be placed in the obtained opening and which the gripper head grabs by means of the claws 13, and the gripper head is returned to the location of the obtained opening. In order to plant the lifting loop-forming part in its position, the claws 13 and the lifting loop-forming part carried thereby are pressed by means of a vertical movement of the gripper head 1 to a determined depth inside the hollow core slab, said depth being sufficient for placing the end sections of the lifting loop-forming part under the hollow core slab's pre-stressing strands. Once the lifting loop-forming part has been pressed to the sufficient depth, it is by means of the claws 13, and the cylinder 11 and the piston rod 12 operating the same, given a permanent or temporary deformation, said deformation enabling a placement of the lifting loop-forming part's end sections under the hollow core slab's pre-stressing strands.

The claws 13 can also be accompanied with a vibrator, by means of which the lifting loop-forming part is subjected to vibration simultaneously with a deformation applied to the part. This serves to enhance embedding the lifting loop-forming part's end sections in fresh concrete mix and also to improve fixing these end sections in concrete mix.

Finally, concrete mix, which has been dropped onto the bottom of the hollow core slab's cavities while making the opening, is compacted for attaching the same next to the lifting loop-forming part by lowering the sawing unit 6 down and by vibrating it by means of the vibrator 10.

What is notable in the above description of FIG. 1 is that the breaking of an opening in the top surface of a hollow core slab by sawing, as well as the placement of a lifting loop-forming part, which have been described as separate operations, can also be conducted concurrently or at least to some extent concurrently. In this case, the sawing unit 6 would be mounted rotatably with respect to the frame element 4, and thereby the rotation of the entire gripper head 1 would not be needed during a sawing operation. Thus, the progress of sawing would be separately controllable by means of the cylinder 8, and the placement of a lifting loop-forming part would be implementable simultaneously by means of the cylinder 11.

The operation of claws included in the apparatus of the invention will be described next with reference to FIG. 2, which shows schematically an example of claws 13 and the construction thereof for use in the apparatus of FIG. 1.

The claws 13 of FIG. 2 consist of two halves 15 and 16, which are pivotably fixed to each other, as well as to the support structure 4 of the gripper head 1 of FIG. 1 by way of the axle 14. The halves 15 and 16 of the claws 13 are pivoted relative to each other by vertical movement of the piston rod 12, which piston rod is connected to top ends of the claw halves with spacers 17 and 18.

In the process of installing a lifting loop-forming part in its position, the hollow core slab is grabbed by using jaws formed by lower portions of the halves 15 and 16 of the claws 13 to take hold of the upper portion of a lifting loop-forming part 19, and the part 19 is pressed with a vertical movement of the gripper head 1 to a determined depth into an opening already established or being established in the hollow core slab. Thereafter, a downward movement of the piston rod 12 is used for forcing the jaws of the claws 13 toward each other, thereby coercing end sections of the lifting loop-forming part 19 under the hollow core slab's pre-stressing strands with a permanent deformation applied to the lifting loop-forming part. The jaws formed by the lower portions of the halves 15 and 16 of the claws 13 are preferably formed with a recessed section for the lifting loop-forming part 19, which recess assists in keeping the lifting loop-forming part stationary, especially when the part is subjected to a deformation by pressing or pulling.

With regard to the design of the claws 13 depicted in FIG. 2, it should be noted that, in a solution of the invention, the jaws formed by the lower portions of the halves 15 and 16 of the claws can have tip sections thereof provided with protrusions extending onto an inner surface of or around the lifting loop-forming part 19, whereby the claws can also be used for forcing the lifting loop-forming part's end sections away from each other by moving the tips of the jaws of the claws 13 away from each other.

FIGS. 3A and 3B illustrate schematically one lifting loop-forming part 20 of the invention. FIG. 3A shows the lifting loop-forming part 20 prior to its placement. Once the lifting loop-forming part 20 has been embedded to a sufficient depth, it will be pressed from the sides as indicated by arrows in FIG. 3A, whereby the lifting loop-forming part is set in a permanent deformation to create the configuration shown in FIG. 3B, wherein end sections 22 of the lifting loop-forming part 20 have been successfully placed under the hollow core slab's pre-stressing strands 21.

What is also notable regarding the lifting loop-forming part 20 of FIGS. 3A and 3B is the fact that it has been constructed by bending a metal rod in just a single plane. Thus, its fabrication is remarkably simpler and cheaper than that of prior art lifting loop-forming parts bearing against the pre-stressing strands of a hollow core slab.

FIGS. 4A and 4B illustrate schematically an optional configuration for a lifting loop-forming part 23, whose curved end sections become effectively fixed in concrete mix, as well as to a hollow core slab's pre-stressing strands 21, thus enhancing retention of the lifting loop in the hollow core slab. The installation of this lifting loop-forming part 23 proceeds as described in connection with FIGS. 3A and 3B, yet this solution additionally requires vibrating of the lifting loop-forming part 23 for improving its embedment and fixation in concrete mix. And, as evident from FIGS. 4A and 4B, also this installation of the lifting loop-forming part 23 requires that the lifting loop-forming part be given a permanent deformation. In this example, as also in the example of FIGS. 3A and 3B, the permanent deformation is achieved by pressing toward each other the downward extending sections of the lifting loop-forming part 23, and sections 24 present at the ends thereof and to be placed under the pre-stressing strands 21.

Furthermore, as also in the example of FIGS. 3A and 3B, this lifting loop-forming part 23 of FIGS. 4A and 4B is also capable of being constructed with bends effected in just a single plane.

FIGS. 5A and 5B illustrate schematically one third embodiment for a lifting loop-forming part of the invention. In this embodiment, a lifting loop-forming part 25 is given a temporary deformation to achieve the configuration shown in FIG. 5A by compressing the lifting loop-forming part 25 as indicated by the arrows and by maintaining this compression. This compression enables end sections 26 of the lifting loop-forming part 25 to pull away from each other. The lifting loop-forming part 25 is pressed into a hollow core slab in the compressed condition shown in FIG. 5A. When the compression on the lifting loop-forming part 25 is terminated, the temporary deformation of the lifting loop-forming part is relieved and the lifting loop-forming part resumes its original configuration as shown in FIG. 5B, whereby the lifting loop-forming part's end sections 26 place themselves under pre-stressing strands 21.

As opposed to the embodiments of FIGS. 3A and 3B as well as 4A and 4B, the lifting loop-forming part 25 of FIGS. 5A and 5B cannot be constructed with bends performed in exactly one single plane because of the lifting loop-forming part's overlapping sections. However, when manufacturing the lifting loop-forming part 25 of FIGS. 5A and 5B, the bends occur nevertheless substantially in one plane, since the overlapping sections are required to be located next to each other almost in contact with each other.

In a lifting loop-forming part 27 according to the embodiment shown in FIGS. 6A and 6B, the lifting loop-forming part's downward extending sections are forced away from each other for achieving a temporary deformation and for distancing the lifting loop-forming part's end sections 28 from each other to attain the condition of FIG. 6A. Once the lifting loop-forming part 27 has become embedded to a determined depth within a hollow core slab in the configuration of FIG. 6A, the lifting loop-forming part is relieved of the forces achieving the temporary deformation therein, whereby the lifting loop-forming part 27 resumes its original configuration and the lifting loop-forming part's end sections 28 place themselves under pre-stressing strands 21 as shown in FIG. 6B.

As for the foregoing example, it is obvious that those can be subjected to a multitude of modifications and variations as evident for a person skilled in the art. Hence, the foregoing examples are by no means limitative regarding the invention, but the scope of protection for the invention is defined solely in accordance with the appended claims.

The invention claimed is:

1. A method for the installation of a lifting loop in a fresh hollow core slab, wherein said hollow core slab having a top surface broken for an opening substantially in line with a neck between cavities therein, said method comprising placing in the obtained opening a lifting loop-forming part set to bear against pre-stressing strands of the hollow core slab, wherein the lifting loop-forming partcomprises end sections that are placed under the pre-stressing strands by providing either a permanent or temporary deformation in the lifting loop-forming part during the placing of the lifting loop-forming part.

2. The method according to claim 1, wherein the lifting loop-forming part is subjected to said permanent or temporary deformation by moving the lifting loop-forming part's end sections toward each other or by moving the lifting loop-forming part's end sections away from each other.

3. The method according to claim 1, further comprising vibrating the lifting loop-forming part simultaneously with providing the deformation or after the deformation.

4. The method according to claim 1, wherein concrete mix broken off the top surface of the hollow core slab in a process of making an opening is compacted to the proximity of the end sections of the lifting loop-forming part after and/or during a placement of the lifting loop-forming part.

5. The method according to claim 1, wherein the lifting loop-forming part comprises a metal bar bent in a single plane.

6. An apparatus for the installation of a lifting loop in a fresh hollow core slab, said apparatus comprising means for placing a lifting loop-forming part in an opening broken in a top surface of the hollow core slab substantially in line with a neck between cavities therein, and means for setting the lifting loop-forming part to bear against pre-stressing strands of the hollow core slab, wherein the means for setting the lifting loop-forming part to bear against the hollow core slab's prestressing strands comprise means for providing either a permanent or temporary deformation in the lifting loop-forming part, said strain during placement of the end sections of the lifting loop-forming part under pre-stressing strands.

7. The apparatus according to claim 6, wherein the means for providing either a permanent or temporary deformation in the lifting loop-forming part, comprise means for moving the end sections of the lifting loop-forming part toward or away from each other.

8. The apparatus according to claim 6, wherein the apparatus further comprises means for vibrating the lifting loop-forming part simultaneously with the deformation provided in the lifting loop-forming part or after the deformation.

9. The apparatus according to claim 6, wherein the apparatus further comprises means for compacting concrete mix broken off the top surface of the hollow core slab to bring the concrete mix into proximity of the end sections of the lifting loop-forming part.

10. The apparatus according to claim 6, wherein the apparatus further comprises means for breaking the top surface of a fresh hollow core slab substantially in line with a neck between the cavities for making an opening in the top surface of the hollow core slab.

11. The apparatus according to claim 6, wherein the lifting loop-forming part comprises a metal bar bent in a single plane.

* * * * *